US009906868B2

(12) United States Patent
Mao et al.

(10) Patent No.: US 9,906,868 B2
(45) Date of Patent: Feb. 27, 2018

(54) MINIATURE SPEAKER

(71) Applicants: Lubin Mao, Shenzhen (CN); Chengxia Ji, Shenzhen (CN); Fei Hou, Shenzhen (CN)

(72) Inventors: Lubin Mao, Shenzhen (CN); Chengxia Ji, Shenzhen (CN); Fei Hou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 15/412,309

(22) Filed: Jan. 23, 2017

(65) Prior Publication Data

US 2018/0027333 A1 Jan. 25, 2018

(30) Foreign Application Priority Data

Jul. 21, 2016 (CN) ..... 2016 2 0774188 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/127* (2013.01); *H04R 7/18* (2013.01); *H04R 9/025* (2013.01)

(58) Field of Classification Search

CPC . H04R 7/127; H04R 7/18; H04R 9/06; H04R 9/025

See application file for complete search history.

(56) References Cited

U.S. PATENT DOCUMENTS

| | | | | |
|---|---|---|---|---|
| 2004/0218778 | A1* | 11/2004 | Weisman | H04R 7/16 381/396 |
| 2005/0276434 | A1* | 12/2005 | Kobayashi | H04R 9/06 381/396 |
| 2006/0162993 | A1* | 7/2006 | Honda | H04R 7/18 181/172 |
| 2008/0137901 | A1* | 6/2008 | Michno | H04R 9/00 381/407 |
| 2014/0056464 | A1* | 2/2014 | Li | H04R 9/025 381/400 |
| 2015/0319535 | A1* | 11/2015 | Xu | H04R 7/18 381/412 |

* cited by examiner

*Primary Examiner* — Tuan D Nguyen
(74) *Attorney, Agent, or Firm* — IPro, PLLC; Na Xu

(57) ABSTRACT

A miniature speaker includes a frame; a vibration system including a diaphragm and a voice coil driving the diaphragm. The diaphragm includes a first fixation part located on a middle position of the diaphragm, a second fixation part located on an edge of the diaphragm and connected fixedly on the frame, and a vibration part connected between the first fixation part and the second fixation part. A magnetic circuit system includes a lower plate and a magnet part on the lower plate. A cover plate includes a bottom wall, and a side wall connected with the second fixation part. A gasket is located between and abuts against the bottom wall and the first fixation part. The gasket, the first fixation part and the magnet part are sandwiched firmly between the bottom wall and the lower plate.

8 Claims, 3 Drawing Sheets

MINIATURE SPEAKER

FIELD OF THE INVENTION

The invention is related to electro-acoustic transducers, more particularly to a miniature speaker used in a portable consumer device.

DESCRIPTION OF RELATED ART

With the coming of mobile internet times, the quantity of intelligent mobile device is rising continuously. Among many mobile equipment, mobile phone is the most common and portable mobile terminal equipment. At present, the function of mobile phone is diversified. One of important functions is that of high quality music, and the miniature speaker in mobile phone is one of the essential conditions of realizing the function of high quality music.

The existing miniature speaker generally includes a housing, a vibration system and a magnetic circuit system. The housing fixes the vibration system and the magnetic circuit systems. The vibration system includes a diaphragm and a voice coil driving the diaphragm to sound. The magnetic circuit system includes two main magnets with the same magnetic poles thereof facing to each other. Two main magnets are welded and connected through glue or laser spot welding. However, the two main magnets are easy to be detached from each other due to the repulsion force between the two magnets, which badly affects the reliability of the miniature speaker.

Therefore, it is necessary to provide an improved miniature speaker to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of the present disclosure more apparent, the present disclosure is described in further detail together with the figures and the embodiment. It should be understood the specific embodiment described hereby is only to explain this disclosure, not intended to limit this disclosure.

Figure 1:
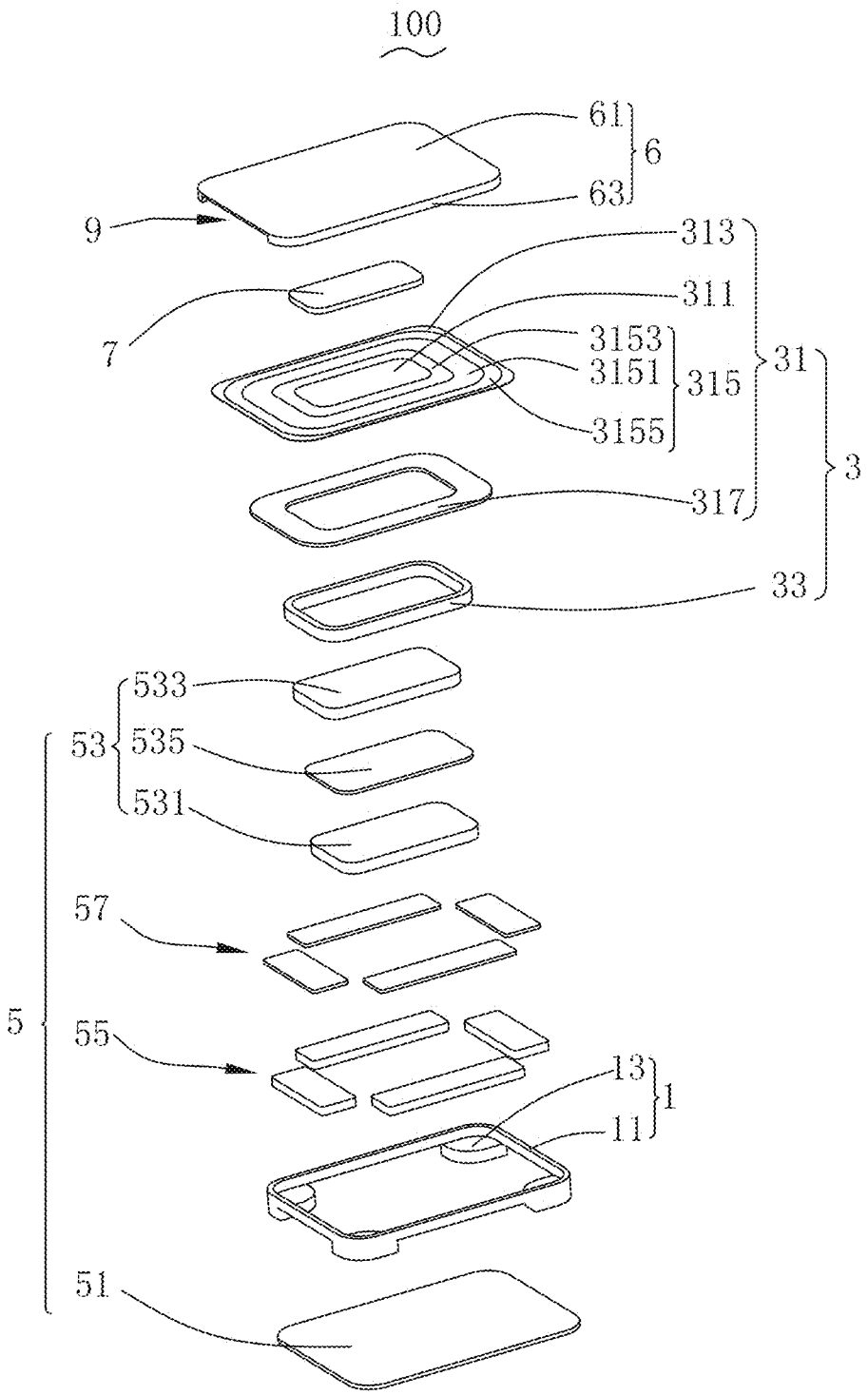
FIG. 1 is an isometric and exploded view of a miniature speaker in accordance with an exemplary embodiment of the present disclosure.
Figure 2:
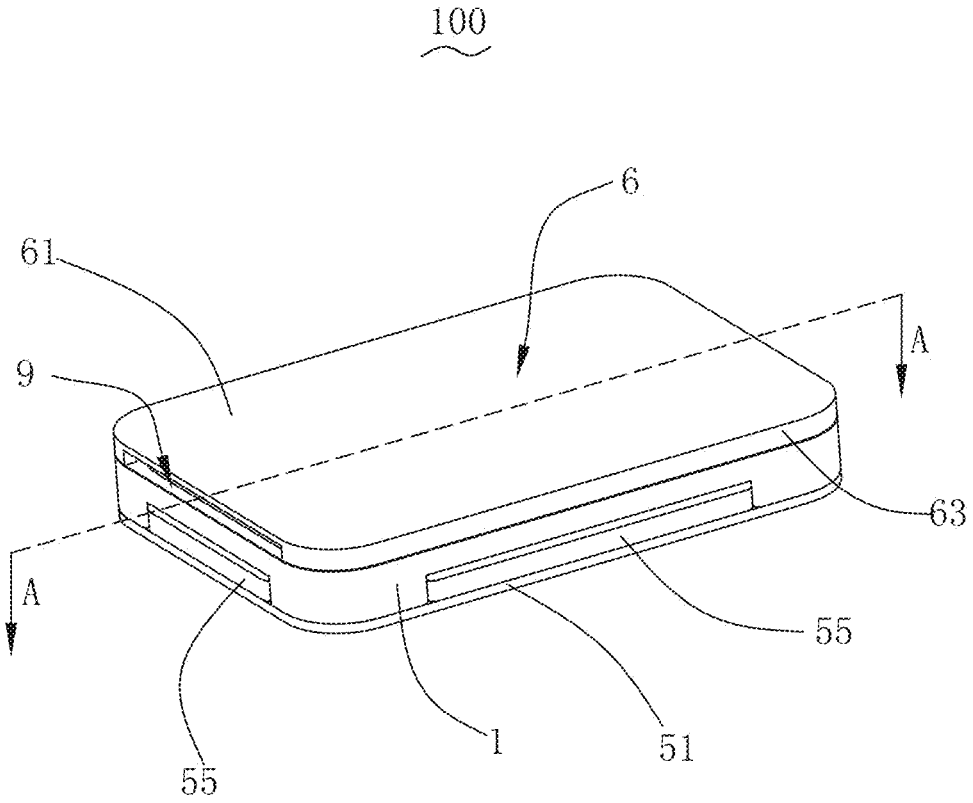
FIG. 2 is an assembled view of the miniature speaker in FIG. 1.
Figure 3:
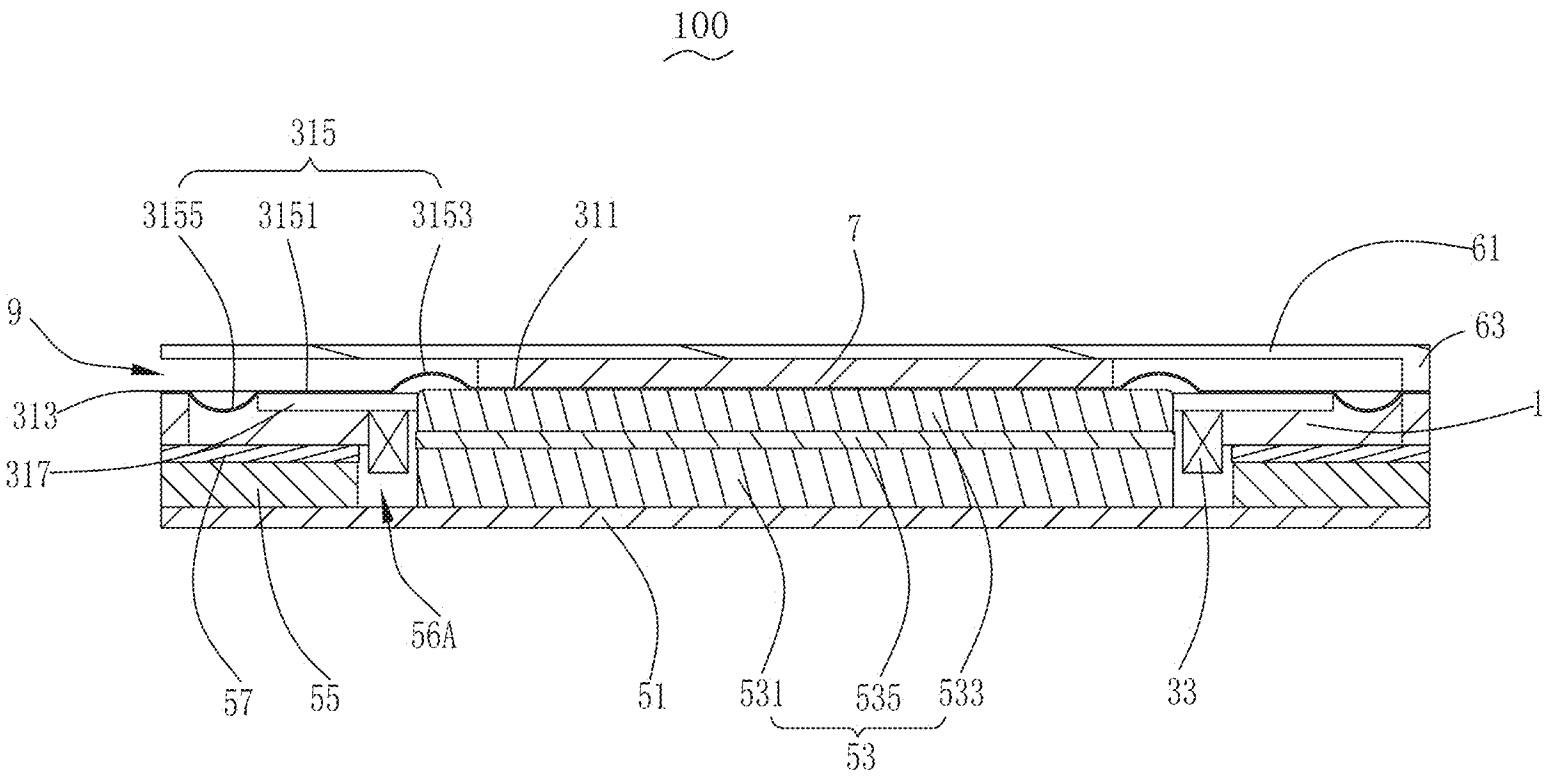
FIG. 3 is a cross-sectional view of the miniature speaker taken along line A-A in FIG. 2.

Referring to FIGS. 1-3, a miniature speaker 100 in accordance with an exemplary embodiment of the present disclosure includes a frame 1, a vibration system 3 and a magnetic circuit system 5 fixed and connected on the frame 1, a cover plate 6 arranged on the vibration system 3 and covering the vibration system, a gasket 7 located between the vibration system 3 and the cover plate 6, and a sound hole 9 formed in the cover plate 6.

The frame 1 includes a hollow rectangular case 11 and a step part 13 extending from four corners of the rectangular case 11 toward the magnetic circuit system 5. The step part 13 is located on the lower side of the rectangular case 11 and abuts against the magnetic circuit system 5.

The vibration system 3 includes a diaphragm 31 and a voice coil 33 driving the vibration of the diaphragm 31. The diaphragm 31 includes a first fixation part 311 located on the middle position of the diaphragm 31, a second fixation part 313 located on the edge position of the diaphragm 31 and a vibration part 315 connected between the first fixation part 311 and the second fixation part 313. The first fixation part 311 is connected with the magnetic circuit system 5. The second fixation part 313 is connected with the rectangular case 11 fixedly and is clamped and set between the rectangular case 11 and the cover plate 6.

The vibration part 315 includes a main vibration body 3151, the a suspension 3153 extending from the inner edge of the main vibration body 3151 and is connected with the first fixation part 311, a second suspension 3155 extending from the outer edge of the main vibration body 3151 and is connected with the second fixation part 313. The main vibration body 3151 is connected with the voice coil 33. The first suspension 3153 is raised on the direction away from the magnetic circuit system 5. The second suspension 3155 is raised on the direction closed to the magnetic circuit system 5, namely the two raised directions are opposite.

Optionally, the diaphragm 31 further includes a dome 317. The dome 317 is attached on an upper surface or lower surface of the main vibration body 3151. In this embodiment, the dome 317 is circular hollow structure which is located on the lower surface of the main vibration body 3151 closed to the magnetic circuit system 5. The voice coil 33 is connected with the dome 317 fixedly.

The magnetic circuit system 5 includes a lower plate 51, a magnet part 53 set on the lower plate 51 to drive the voice coil 33, auxiliary magnets 55 set around the magnet part 53 and auxiliary pole plates 57 attached on the auxiliary magnets 55.

The magnet part 53 includes a first magnet 531, and a second magnet 533 set on the first magnet 531 and a pole plate 535 sandwiched between the first magnet 531 and the second magnet 533. The first magnet 531 and the second magnet 533 are such configured that a magnetic pole of the first magnet faces the same magnetic pole of the second magnet. It can be set in N-S-S-N way and S-N-N S way as well. The magnet part 53 is disposed on the lower part of the first fixation part 311 and the first fixation part 311 is connected with the magnet part 53 fixedly. Specifically, the first fixation part 311 is attached on the surface of the second magnet 533.

The auxiliary magnets 55 surrounds the magnet part 53 and forms a magnetic gap 56A with the magnet part 53. The voice coil 33 is suspended on the magnetic gap 56A. In this embodiment, the quantity of the magnetic gap 55 is four. The quantity of the auxiliary pole plate 57 is four which are attached on the surface of the magnetic gap 55 facing to the diaphragm 31. Specifically, four said magnetic gap 55 is located on the lower part of the rectangular case 11 set and clamped on the adjacent the step part 13 separately. Specifically, two magnetic gaps 55 are set symmetrically along the direction of the length of the rectangular case 11. Two magnetic gaps 55 are set symmetrically along the width direction of the rectangular case 11.

The cover plate 6 is covered and connected on the upper side of the diaphragm 31. The cover includes a bottom wall 1 set oppositely to the lower plate 51 and a side wall 63 extending from the bottom wall 61 to the direction of the diaphragm 31. The side wall 63 is covered and connected on the second fixation part 313.

The gasket 7 is clamped and set between the bottom wall 61 and the first fixation part 313. The gasket 7 is magnet. Preferably, the direction of magnetizing is the magnet is the same as the second magnet 533. The space between the first fixation part 313 and said bottom wall is utilized effectively, and then the magnetic performance of the miniature speaker 100 is improved.

The bottom wall 61, the gasket 7, the first fixation part 311, the second magnet 533, the pole plate 535, the first magnet 531 and the lower plate 51 are stacked layer by layer. The bottom wall 61 and the lower plate 51 press tightly the gasket 7, the first fixation part 311 and the magnet part 53 between the bottom wall 61 and the lower plate 51.

The miniature speaker 100 is the sounding speaker of the side wall. The sound hole 9 is set on the side wall 63 of the cover plate 6.

The miniature speaker 100 provided by the present disclosure utilizes reasonably the space between the cover plate 6 and diaphragm 31, and by adding gasket 7 between the bottom wall 61 of the cover plate 6 and the first fixation part 311 of the diaphragm 31. The bottom wall 61 and the lower plate 51 press tightly the gasket 7, the first fixation part 311 and the magnet part 53 between the bottom wall 61 and the lower plate 51 to fix the magnet part 53 firmly, therefore the reliability of assembling is improved. In addition, the gasket 7 can be a magnet which improves the magnetic performance further.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature speaker including:

a frame;

a vibration system including a diaphragm and a voice coil driving the diaphragm, the diaphragm including a first fixation part located on a middle position of the diaphragm, a second fixation part located on an edge of the diaphragm and connected fixedly on the frame, and a vibration part connected between the first fixation part and the second fixation part;

a magnetic circuit system supported by the frame, and including a lower plate and a magnet part on the lower plate;

a cover plate located above the diaphragm, the cover plate including a bottom wall, and a side wall extending from the bottom wall toward the diaphragm and connected with the second fixation part;

a gasket located between and abutting against the bottom wall and the first fixation part;

wherein the vibration part includes a main vibration body, a first suspension extending from an inner edge of the main vibration body and connected with the first fixation part, and a second suspension extending from an outer edge of the main vibration body and connected with the second fixation part;

the first fixation part is connected with the magnet part fixedly; and the gasket, the first fixation part and the magnet part are sandwiched firmly between the bottom wall and the lower plate.

2. The miniature speaker as described in claim 1, wherein the gasket is a magnet.

3. The miniature speaker as described in claim 1, wherein the magnet part includes a first magnet and a second magnet stacked on the first magnet and such configured that a magnetic pole of the second magnet faces a same magnetic pole of the first magnet; the first fixation part is attached to the second magnet.

4. The miniature speaker as described in claim 3, wherein the magnet part also includes a pole plate sandwiched between the first magnet and the second magnet.

5. The miniature speaker as described in claim 3, wherein the gasket is a magnet having a magnetizing direction same to the second magnet.

6. The miniature speaker as described in claim 3 further including a sound hole in the side wall of the cover plate.

7. The miniature speaker as described in claim 1, wherein the magnetic circuit system further includes auxiliary magnets disposed on the lower plate around the magnet part for forming a magnetic gap, and the voice coil is suspended in the magnetic gap.

8. The miniature speaker as described in claim 1, wherein the diaphragm further includes a dome attached on an upper surface or a lower surface of the main vibration body.

* * * * *